United States Patent [19]

Danchulis

[11] Patent Number: 4,720,094

[45] Date of Patent: Jan. 19, 1988

[54] EXERCISE APPARATUS WITH LOCKING MEANS

[76] Inventor: James E. Danchulis, 244 Sunset Dr., Pittsburgh, Pa. 15235

[21] Appl. No.: 19,080

[22] Filed: Feb. 26, 1987

Related U.S. Application Data

[62] Division of Ser. No. 736,142, May 20, 1985.

[51] Int. Cl.[4] ..... A63B 23/04; B62K 21/22

[52] U.S. Cl. ..... 272/73; 74/551.1; 403/347; 403/362

[58] Field of Search ..... 272/73; 73/551.1–551.9; 403/362, 373, 104, 347; 280/281 R, 287

[56] References Cited

U.S. PATENT DOCUMENTS

| | | | |
|---|---|---|---|
| 1,725,531 | 8/1929 | Langsner | 403/104 |
| 3,357,726 | 12/1967 | Gabrielson | 287/14 |
| 3,463,520 | 8/1969 | Turro | 403/362 |
| 3,849,008 | 11/1974 | Boucher et al. | 403/104 |
| 3,955,828 | 5/1976 | Boudreau | 280/279 |
| 4,378,111 | 3/1983 | Tsuchida et al. | 272/73 |
| 4,653,745 | 3/1987 | Nakao et al. | 403/362 |

*Primary Examiner*—Richard J. Apley
*Assistant Examiner*—S. R. Crow
*Attorney, Agent, or Firm*—Arnold B. Silverman

[57] ABSTRACT

Exercise apparatus having locking means for facilitating adjustable positioning of a portion thereof. The exercise apparatus may take the form of an exercise bicycle or other equipment. The locking means are adapted to have a component positioned within a tubular member of the exercise apparatus and receive an adjustable member passing therethrough. The locking means components are adapted to be moved in a path generally transverse to the axis of the adjustable member and are adapted to provide compressive locking action to the adjustable member in the desired position.

6 Claims, 7 Drawing Figures

EXERCISE APPARATUS WITH LOCKING MEANS

This is a division of application Ser. No. 736,142, filed May 20, 1985.

BACKGROUND OF THE INVENTION

1. Field Of The Invention

This invention relates to exercise apparatus having locking means to facilitate positioning of an adjustable member in a desired position.

2. Description Of The Prior Art

In connection with exercise apparatus of various types it has been known to provide means whereby translational or rotational movement of a component may be effected after which the component may be locked in a desired position. Such movements are frequently necessary or desirable as a result of users of different sizes and physical characteristics needing to have different dimensional relationships with the apparatus. Such adjustments are frequently desirable not merely as a matter of comfort, but also in order to facilitate improved safety and efficient use of the equipment.

In exercise apparatus such as stationary bicycles, for example, it will frequently be necessary or desirable to adjust the elevation of the seat which supports the user, the elevation of the handlebars which are engaged by the user as well as other portions of the apparatus.

While numerous means have been suggested for use in this context, there remains a need for improved locking devices for use in this environment.

SUMMARY OF THE INVENTION

The present invention has met the above described need by providing an exercise apparatus and associated locking means for securing at least one adjustable member in a desired position. A tubular portion of the exercise apparatus receives a portion of the locking means which is threadedly connected to an external operating knob. Rotation of the operating knob in a first direction establishes compression in the locking means portion disposed within the tubular portion thereby effecting locking of the adjustable member in the desired position.

In one embodiment, a unitary frame-like locking member has the adjustable member passing therethrough and cooperates with recesses in the wall of the tubular portion of the exercise apparatus. In effecting locking, the knob is rotated in a first direction so as to place the frame-like locking member in compression and thereby lock the adjustable member in the desired position.

In another preferred embodiment, a pair of tubular members have associated cooperating recesses which when the knob means are rotated in a first direction will establish compression in the two tubular members to thereby lock the adjustment member in the desired position.

These and other objects of the invention will be more fully understood from the following description of the invention on reference to the illustrations appended hereto.

DESCRIPTION OF THE PREFERRED EMBODIMENTS

Figure 1:
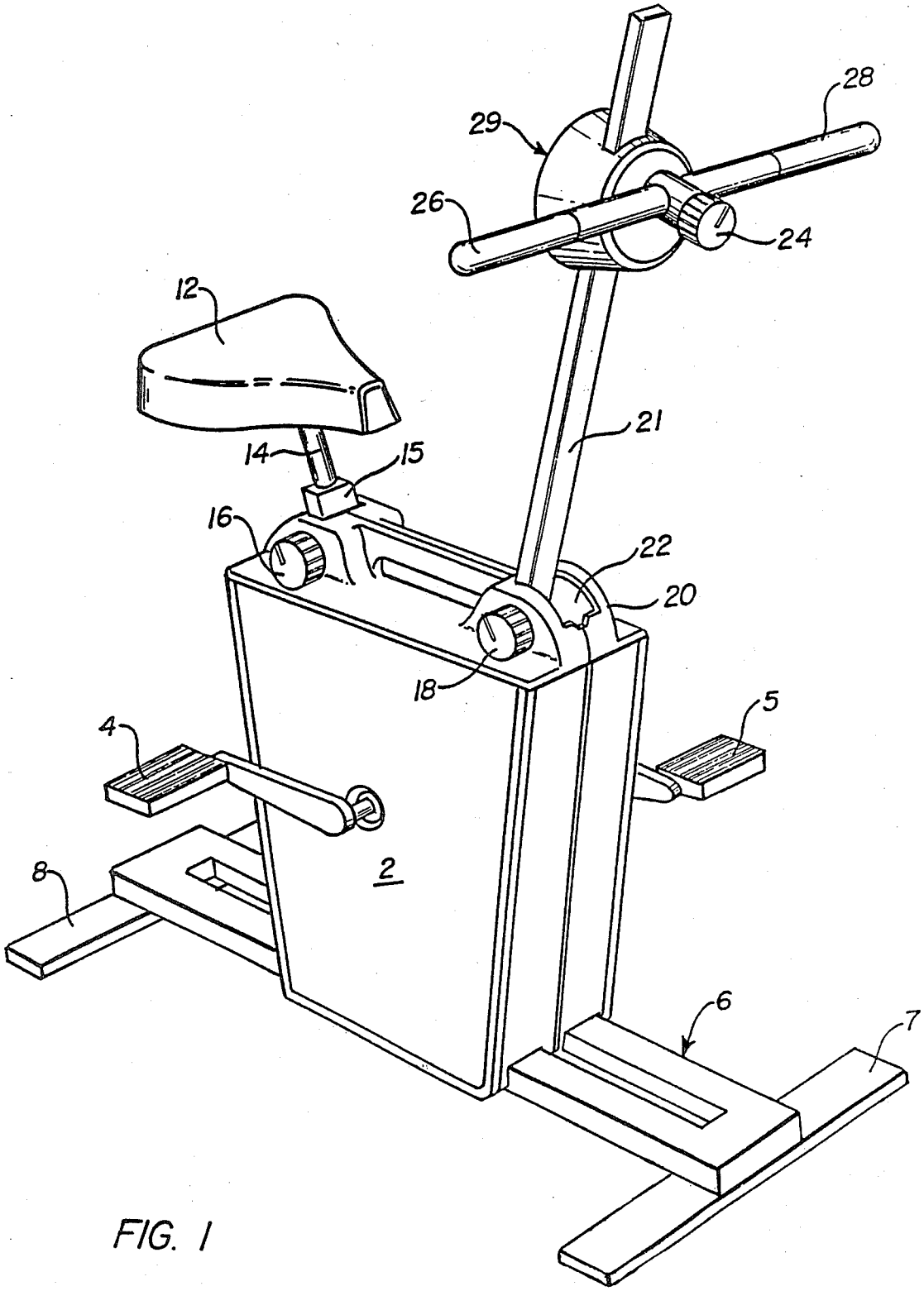
FIG. 1 is a perspective view of a form of exercise bicycle employing locking devices of the present invention.

Referring again to FIG. 1, there is shown an exercise bicycle which has a body portion 2, a pair of pedals 4, 5, longitudinal base support 6, a pair of transverse base supports 7, 8 and a seat 12 which is supported by adjustable member 14 whose position is locked by locking means 16 of the present invention. Adjustment member 14 is received within tubular member 15 which in turn cooperates with locking means 16. Adjustable member 21 is received within tubular member 20 having opening 22 and in turn cooperates with locking means 18. Locking means 18 secures adjustment member 21 in the desired angular position within opening 22 and locking means 24 secures handlebars 26, 28 and housing 2*a* in the desired axial position on adjustable member 21. The housing 21 which in the form shown is movable with handlebars 28, 29 on adjustable member 21 and may contain electronics and display means to show speed, distance, calories used and the like. In this manner, by adjusting locking means 16, 18 and 24 the elevation of seat 12, the elevation of handlebars 26, 28 and the rotational position of handlebars 26, 28 may be established.

Figure 2:
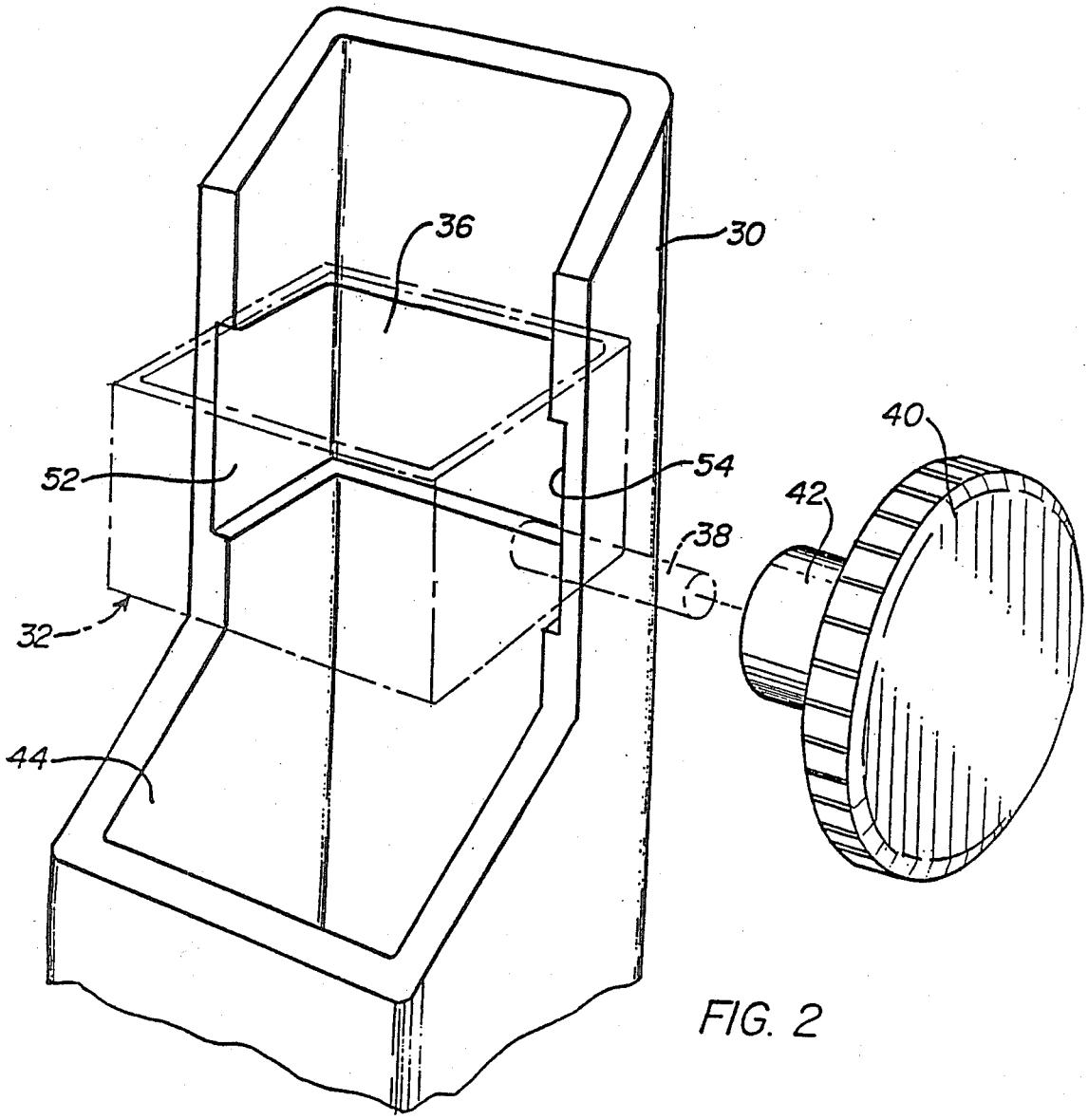
FIG. 2 is a partially exploded, partially in section schematic illustration of a first embodiment of locking means of the present invention.
Figure 3:
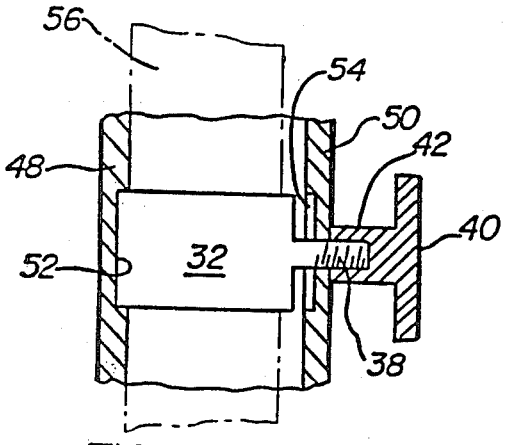
FIG. 3 is a cross-sectional illustration showing the apparatus of FIG. 2 in locked position.
Figure 4:
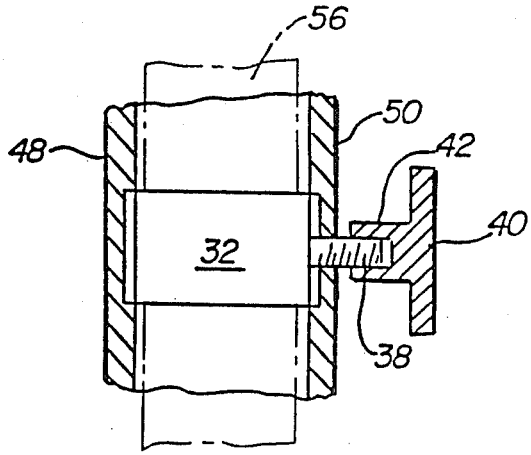
FIG. 4 is a cross-sectional illustration showing the apparatus of FIG. 2 in unlocked position.

Referring to FIGS. 2 through 4, a preferred embodiment of the present invention will be considered. A tubular portion 30 of the apparatus which will receive an adjustable member 56 is provided with an opening so that the locking means may be provided. The locking means in this embodiment consists of a frame-like member 32 which defines an opening 36 within which adjustable member 56 may be reciprocated when the locking means is in unlocked position. Fixedly secured to the locking member 32 is a threaded stud 38 which projects through the opening in the tubular portion 30 and is threadedly engaged within hub portion 42 of knob 40. It will be appreciated that as the knob is rotated in a first direction the framing member 32 will be urged responsively in a path oriented generally transversely with respect to the longitudinal axis of the adjustable member 56. The apparatus is such that movement in a first direction will establish locking of the adjustable member 56 in a desired position and the rotation of the knob 40 in the other direction will unlock the adjustable member 56. The adjustable member 56 will be received within the passageway 44 of the tubular member 30.

As is shown, the tubular portion 30, in the preferred embodiment has a pair of generally opposed recesses 52, 54. In the locked position, such as is shown in FIG. 3, the framing member 32 will be received in the recess 54 disposed adjacent to knob 40. When it is desired to unlock the adjustable member for moving it to another position or rotating the same, the knob 40 is rotated in the opposite direction thereby causing translational movement of the framing member 32 in a path generally transverse to the longitudinal axis of adjustment member 56 and relieving the compressive restraint thereby permitting free movement of the adjustment member 56.

It will be appreciated that this device permits effective secure locking of the adjustable member which may directly or indirectly be secured to a seat, handlebars or other portions of exercise apparatus desired to be moved while permitting manual operation in an easy manner.

While the embodiment of FIGS. 2 through 4 illustrate a generally rectangular frame member 32 associated with a generally rectangular tubular member 30 it will be appreciated that the members 30, 32 may be of generally circular configuration or any other desired configurations. One advantage of having a non-circular configuration is that undesired rotation of the frame member 32 with respect to the tubular member 30 is resisted.

Figure 5:
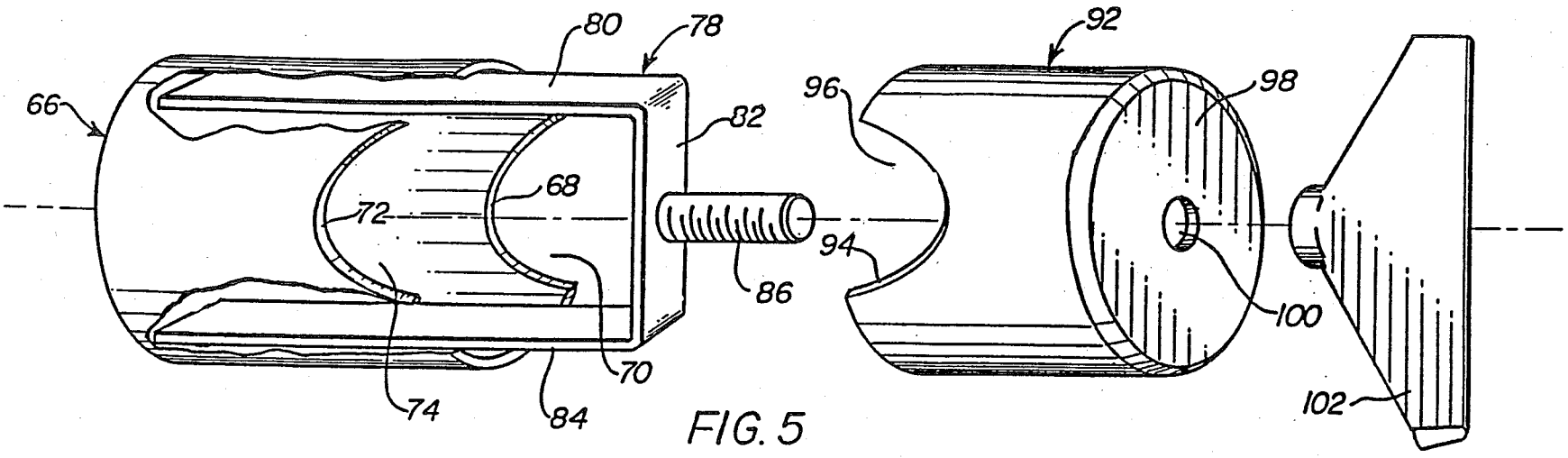
FIG. 5 is an exploded partially schematic deal of another embodiment of the locking means of the present invention.
Figure 7:
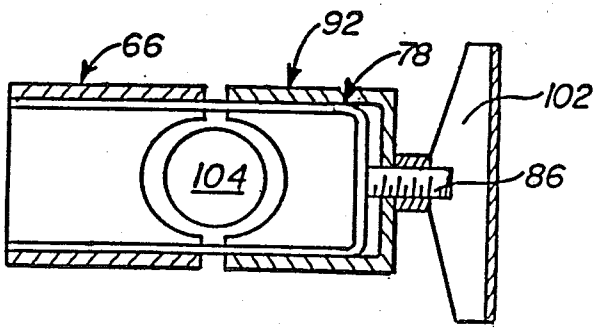
FIG. 7 is a cross-sectional illustration showing the embodiment of FIG. 5 in unlocked position.
Figure 6:
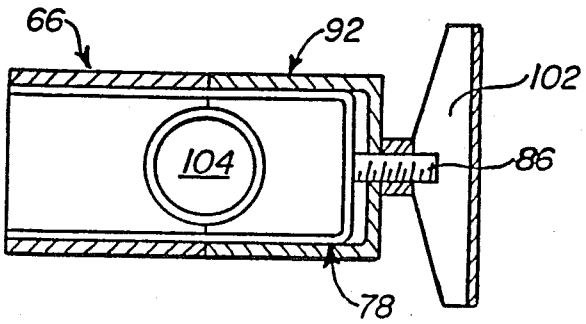
FIG. 6 is a cross-sectional illustration showing the embodiment of FIG. 5 in locked position.

Referring further to FIGS. 5 through 7 a further embodiment of the invention will be considered. In this embodiment, a first tubular locking member 66 is provided with a pair of relieved surfaces 68, 72 which define, respectively, recesses 70, 74. Connecting means 78 are fixedly secured to the tubular element 66 and, in the form shown, are of generally U-shape having a pair of lateral walls 80, 84 and a base wall 82. A threaded stud 86 is fixedly secured to the base wall 82 and projects outwardly therefrom. In use, the tubular element 66 and the connecting member 78 would be disposed within a tubular portion such as portion 30 in FIG. 2 with the stud 86 projecting through an opening in the tubular portion. A second tubular element 92 would also be positioned within the tubular portion 30. This member also has a pair of surfaces 94 (second surface not shown) which define recesses 96 (second recess not shown). This structure has a closed end wall 98 having an aperture 100 through which stud 86 passes. Knob 102 is threadedly secured to stud 86. The four recesses (two opposed pairs) in the two tubular elements 66, 92 are adapted, when in closed position and placed in compression to effect clamping engagement with the adjustable member 104. FIG. 6 shows the structure in compressed condition locking the adjustable member 104 and FIG. 7 shows the structure in unlocked position which permits rotational and translational movement of adjustable member 104.

While the devices of the present invention may have locking components made of any suitable material, it is presently preferred to make them of a suitable metal or resinous plastic.

While several preferred geometric configurations have been illustrated for purposes of clarity of disclosure, it will be appreciated that the invention is not so limited. A prime feature of the invention is that the construction be such that rotation of an externally disposed knob which is threadedly secured to a framing component results in the framing elements disposed within the tubular member being placed in compression so as to lock the adjustable member which has a path of movement generally transverse thereto in secure position.

While for convenience of reference herein specific reference has been made to exercise bicycles it will be appreciated by those skilled in the art that the apparatus of the present invention may be employed in a wide variety of types of exercise equipment such as rowing machines, fitness treadmills and pogo sticks, for example.

Whereas particular embodiments of the invention have been described above for purposes of illustration, it will be appreciated by those skilled in the art that numerous variations of the details may be made without departing from the invention as described in the appended claims.

I claim:

1. Exercise apparatus comprising a body support portion, a manually engageable portion, locking means for securing at least one said portion in a desired position, a tubular member operatively associated with said locking means having an opening for receipt of a portion of said locking means, an adjustable member operatively associated with at least one said portion and extending through a part of said locking means within said tubular member, said locking means having adjustable member clamping means and knob means for positioning said clamping means, said clamping means having a pair of tubular segments, each with recesses adapted to cooperate with the recesses of the other said segment to engage said adjustable member with said tubular segments when said tubular segments are in locking position and to be withdrawn from locking engagement when said tubular members are in unlocked position, said locking means having connector means for threadedly securing a first said tubular segment to said knob, and the second said tubular segment being interposed between said knob and said first tubular segment, whereby rotation of said knob in a first direction will establish relative closing movement between said tubular segments and create compressive locking engagement of said adjustable member.

2. The exercise apparatus of claim 1 including said exercise apparatus being an exercise bicycle.

3. The exercise apparatus of claim 1 including said connector means being secured to said first tubular segment and having a threaded stud extending through said tubular member into a threaded engagement with said knob.

4. The exercise apparatus of claim 3 including said connector means being of generally U-shaped configuration with said threaded stud projecting from the base therof.

5. Exercise apparatus comprising a body support portion, a locking means for securing an adjustment member operatively associated with said portion, a locking element for positioning within a tubular member of said locking means, knob means threadedly connected to the locking element for applying compressive locking action to the locking element in securing said adjustment member in a desired position, said locking element having a pair of tubular elements each having a pair of recesses which cooperates with the recesses of the other to establish clamping locking action on the adjustment member when compressive relative closing movement is applied to the two tubular elements, and a threaded stud means secured to one of said tubular elements and operatively associated with the other and being threadedly engaged with said knob means.

6. The locking means of claim 5 including said stud means being fixedly secured to connecting means which in turn are fixedly secured to one said tubular element.

* * * * *